US011988215B2

(12) United States Patent
Matsumoto

(10) Patent No.: US 11,988,215 B2
(45) Date of Patent: May 21, 2024

(54) BLOWER UNIT, AND BLOWER UNIT ATTACHMENT STRUCTURE

(71) Applicant: PANASONIC INTELLECTUAL PROPERTY MANAGEMENT CO., LTD., Osaka (JP)

(72) Inventor: Koichiro Matsumoto, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 460 days.

(21) Appl. No.: 17/311,237

(22) PCT Filed: Nov. 28, 2019

(86) PCT No.: PCT/JP2019/046660
§ 371 (c)(1),
(2) Date: Jun. 4, 2021

(87) PCT Pub. No.: WO2020/121835
PCT Pub. Date: Jun. 18, 2020

(65) Prior Publication Data

US 2022/0120283 A1 Apr. 21, 2022

(30) Foreign Application Priority Data

Dec. 12, 2018 (JP) ..... 2018-232910

(51) Int. Cl.
*F04D 25/06* (2006.01)
*F04D 29/40* (2006.01)
(Continued)

(52) U.S. Cl.
CPC ..... *F04D 25/0693* (2013.01); *F04D 29/403* (2013.01); *F04D 29/4226* (2013.01); *F04D 29/441* (2013.01); *F04D 29/626* (2013.01)

(58) Field of Classification Search
CPC ..... F04D 25/0693; F04D 29/4226; F04D 29/4233; F04D 29/422; F04D 29/626;
(Continued)

(56) References Cited

U.S. PATENT DOCUMENTS 5,622,485 A * 4/1997 Stewart ..... F04D 29/626 417/423.15
2006/0245920 A1* 11/2006 Hou ..... F04D 29/4226 415/206
(Continued)

FOREIGN PATENT DOCUMENTS

CN 1716731 A 1/2006
DE 102015213471 A1 1/2017
(Continued)

OTHER PUBLICATIONS

International Search Report issued in International Patent Application No. PCT/JP2019/016660, dated Feb. 4, 2020; with English translation.

*Primary Examiner* — Bryan M Lettman
(74) *Attorney, Agent, or Firm* — Rimon P.C.

(57) ABSTRACT

A blower unit includes at least a blower case that is hollow and a centrifugal fan coupled to a rotational shaft of a motor that is housed in the blower case and has the rotational shaft in an integrally rotatable manner. The blower case includes an outer surface including two side surfaces facing each other at a predetermined interval, and an outer circumferential surface continuous with the two side surfaces. The blower case includes a suction port, an air discharge portion provided with an exhaust port at a distal end, and a wire harness outlet. The exhaust port and the wire harness outlet face in the same direction as viewed from the side surface.

15 Claims, 10 Drawing Sheets

(51) Int. Cl.
*F04D 29/42* (2006.01)
*F04D 29/44* (2006.01)
*F04D 29/62* (2006.01)

(58) Field of Classification Search
CPC ..... F04D 29/403; F04D 29/441; F04D 29/42; F04D 29/4206; F04D 29/624
See application file for complete search history.

(56) References Cited

U.S. PATENT DOCUMENTS

| | | | | |
|---|---|---|---|---|
| 2008/0219838 | A1 | 9/2008 | Kusano | |
| 2016/0177957 | A1 | 6/2016 | Santucci | |
| 2020/0386238 | A1* | 12/2020 | Fujita | F04D 29/601 |

FOREIGN PATENT DOCUMENTS

| | | | |
|---|---|---|---|
| JP | S62-251418 | A | 11/1987 |
| JP | H09-126198 | A | 5/1997 |
| JP | 2008-215330 | A | 9/2008 |
| JP | 2013-104365 | A | 5/2013 |

* cited by examiner

BLOWER UNIT, AND BLOWER UNIT ATTACHMENT STRUCTURE

CROSS-REFERENCE OF RELATED APPLICATIONS

This application is the U.S. National Phase under 35 U.S.C. § 371 of International Patent Application No. PCT/JP2019/046660, filed on Nov. 28, 2019, which in turn claims the benefit of Japanese Application No. 2018-232910, filed on Dec. 12, 2018, the entire disclosures of which Applications are incorporated by reference herein.

TECHNICAL FIELD

The present invention relates to a blower unit to be attached and fixed to a vehicle, and a blower unit attachment structure.

BACKGROUND ART

In recent years, various types of electric devices have been attached to and used in a vehicle. For example, a blower unit housing therein a motor and a centrifugal fan in which an airflow generated in the centrifugal fan due to rotation of the motor is discharged from an exhaust port provided in a peripheral wall of a blower case has been widely used for cooling various types of devices in the vehicle. It is necessary to fix the blower unit at a predetermined position so that the airflow flows stably to the device to be cooled.

For example, Patent Document 1 discloses a configuration in which a blower case and a plurality of fixing attachment legs each having a through hole for screwing are integrally formed. According to this configuration, a blower unit is fixed at a predetermined position by screwing the fixing attachment legs to an attachment base (see, for example, Patent Document 1).

CITATION LIST

Patent Document

Patent Document 1: Japanese Unexamined Patent Publication No. 2013-104365

SUMMARY OF THE INVENTION

Technical Problem

Typically, a blower unit is provided in a vehicle such that an exhaust port of the blower unit does not face in a direction (hereinafter, referred to as "upward") within ±90° with reference to an upper side in a vertical direction, thereby making it possible to reduce the risk that foreign objects enter the blower unit. The blower unit is provided in a vehicle to face in a direction (hereinafter, referred to as "downward") within ±90° with reference to a lower side in the vertical direction.

On the other hand, accompanied with the development of vehicle electrification and an increase in the number of devices mounted in a vehicle, it has been becoming difficult to put limitation on an attachment position of the blower unit in the vehicle. For example, an installation position of a storage battery that is a device to be cooled in the vehicle differs for each vehicle model. Thus, it has been necessary to change the attachment position and angle of the blower unit in the vehicle depending on the vehicle model, as well.

However, this has caused a problem that waterdrops may enter the blower unit through a wire harness connected to the motor inside the blower unit, for example, imparting an adverse effect on the motor.

To avoid this, the blower case may be designed such that a wire harness outlet of the blower unit always faces downward, for example.

However, in a case in which a conventional blower unit disclosed in Patent Document 1 is attached to the vehicle, it is necessary to change the design of the blower case fir each vehicle model to make the arrangement and shape of the fixing attachment legs correspond to the attachment position and angle. It has also been necessary to change the design of the blower case to prevent moisture from entering through the wire harness outlet while the exhaust port is kept facing downward. Further, with these design changes, development man-hours and manufacturing costs of the blower unit have increased.

In view of the foregoing, it is an object of the present invention to provide a blower unit and a blower unit attachment structure capable of preventing moisture from entering the motor through the wire harness, even in a case in which the attachment position and the attaching angle in a vehicle are changed.

Solution to the Problem

In order to achieve the above objective, the blower unit according to the present invention includes at least: a hollow blower case; a motor that is partially housed in the blower case and has a rotational shaft extending in a predetermined direction; a centrifugal fan housed in the blower case and coupled to the rotational shaft of the motor in an integrally rotatable manner; and a wire harness outlet provided in either one of the motor or the blower case so that a wire harness supplying power to the motor is drawn out to an outside of the motor or the blower case, wherein the blower case includes an outer surface that includes: two side surfaces facing each other at a predetermined interval; and an outer circumferential surface extending from an outer circumferential edge of one of the two side surfaces to an outer circumferential edge of another one of the two side surfaces, and is continuous with the two side surfaces, a suction port provided in either one of the two side surfaces, and an air discharge portion extending from the outer circumferential surface and including, at a distal end thereof, an exhaust port discharging an airflow; and the exhaust port and the wire harness outlet face in a same direction as viewed from either one of the two side surfaces of the blower case.

According to this configuration, since the exhaust port and the wire harness outlet face in the same direction, the wire harness outlet always faces downward, which makes it possible to reduce the risk that moisture enters the motor through the wire harness. Further, this configuration eliminates the need to change the design of the blower case, even in a case in which the attachment position and the attachment angle of the blower unit inside the vehicle are changed, which allows for standardization of the specifications. Accordingly, it is possible to reduce an increase in the design man-hours and the manufacturing costs of the blower unit.

Advantages of the Invention

As described above, according to the blower unit of the present invention, moisture may be prevented from entering the motor provided in the blower unit through the wire harness. Further, it is possible to reduce an increase in the design man-hours and the manufacturing costs of the blower unit.

DESCRIPTION OF EMBODIMENTS

Embodiments of the present invention will be described in detail with reference to the drawings. The following description of advantageous embodiments is a mere example in nature, and is not at all intended to limit the scope, applications, or use of the present invention.

First Embodiment

[Structure of Blower Unit]

Figure 1:
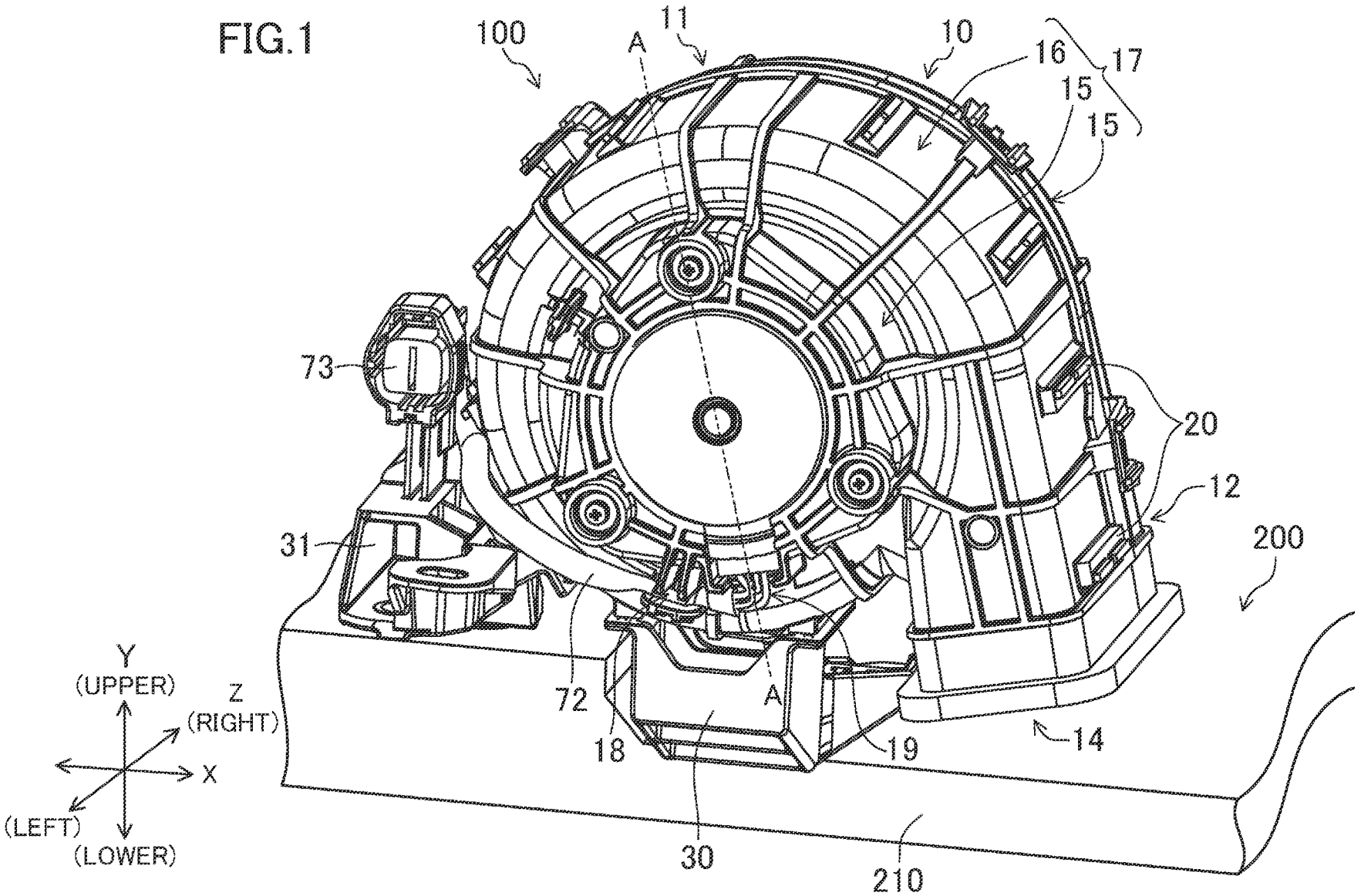
FIG. 1 is a perspective view illustrating a blower unit attachment structure according to a first embodiment of the present invention.
Figure 2:
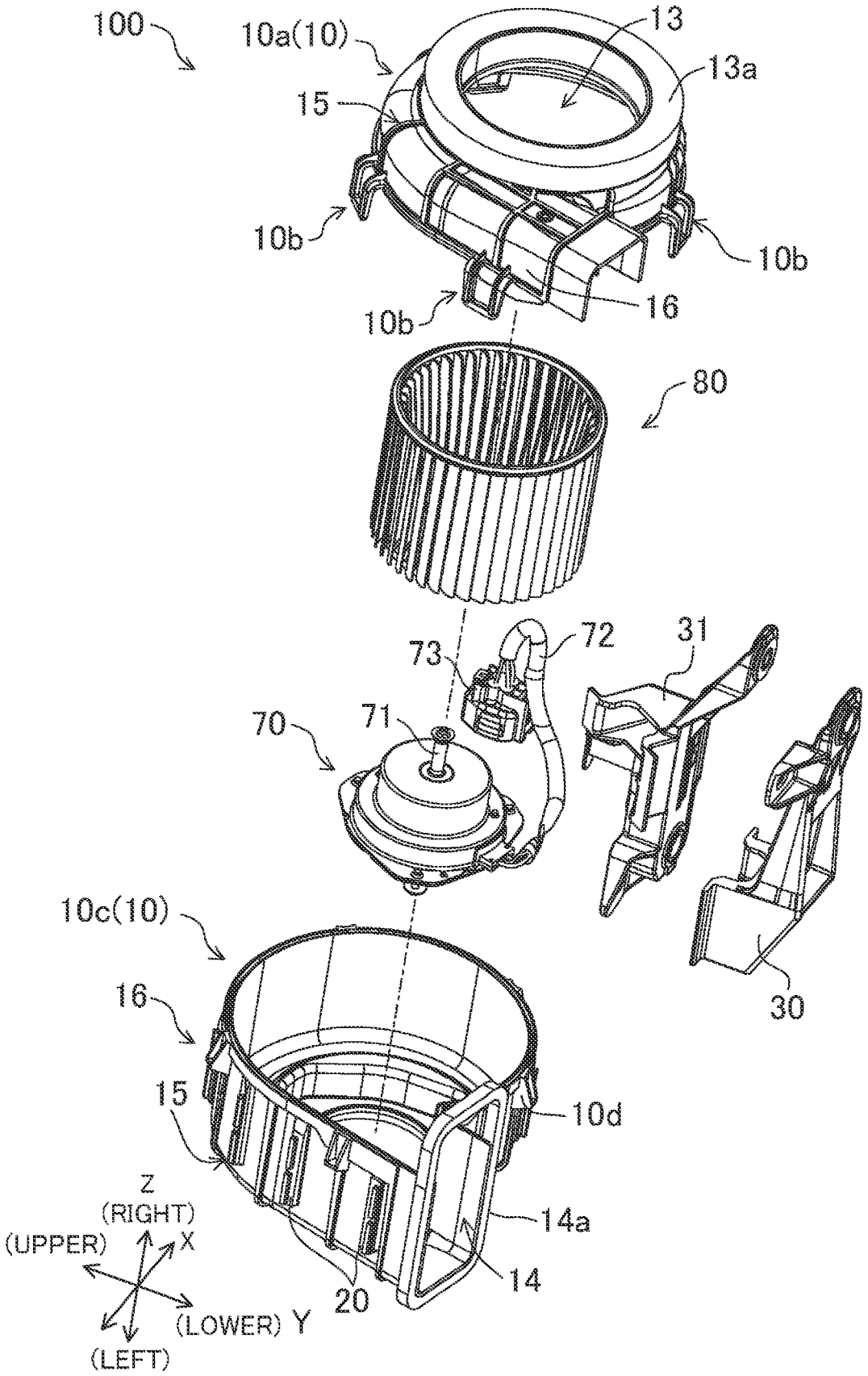
FIG. 2 is an exploded perspective view illustrating the blower unit.

FIG. 1 is a perspective view illustrating an attachment structure in which a blower unit of the present embodiment is attached to a vehicle. FIG. 2 is an exploded perspective view illustrating the blower unit. Note that in the following description, a direction in Which a rotational shaft 71 of a motor 70 extends may be referred to as a "Z direction," a vertical direction may be referred to as a "Y direction," and a direction orthogonal to the Y and Z directions may be referred to as an "X direction." Further, viewed in the Z direction, a side on which a suction port 13 of a blower case 10 is provided may be referred to as a "right side," and a side opposite to the right side may be referred to as a "left side". Viewed in the Y direction, a lower side in a vehicle 200 may be referred to as a "lower side," and a side opposite to the lower side may be referred to as an "upper side". The X direction may be referred to as a "horizontal direction" of the vehicle.

A blower unit 100 is provided inside the vehicle 200 such that an exhaust port 14 faces a storage battery (not shown) that is a device to be cooled. The blower unit 100 includes the blower case 10, the motor 70, a centrifugal fan 80, and two fixing members 30 and 31. The motor 70 and the centrifugal fan 80 are housed inside the blower case 10.

In the following description, two sides of the blower case 10 facing each other in the Z direction may be referred to as side surfaces 15 of the blower case 10. A surface that extends from an outer circumferential edge of one of the side surfaces 15 to an outer circumferential edge of the other side surface 15 and is continuous with the two side surfaces 15 may be referred to as an outer circumferential surface 16 of the blower case 10. The side surfaces 15 and the outer circumferential surface 16 of the blower case 10 may be collectively referred to as an outer surface 17 of the blower case 10.

The blower case 10 is a hollow member obtained by molding resin. The blower case 10 includes a device housing 11 and an air discharge portion 12. The device housing 11 is formed into a shape of a circular box with the suction port 13 on one of the side surface 15, and houses the motor 70 and the centrifugal fan 80. The air discharge portion 12 includes, at its distal end, an exhaust port 14 discharging an airflow. The air discharge portion 12 is a cylindrical member that discharges, from the exhaust port 14, an airflow generated due to the rotation of the centrifugal fan 80. The air discharge portion 12 extends in a direction that forms a predetermined angle with the X direction. Sealing members 13*a* and 14*a* are provided on a circumferential edge of the suction port 13 and a circumferential edge of the exhaust port 14, respectively. The blower case 10 contains a component absorbing a laser beam of a predetermined wavelength which will be described later, for example, pigment, in resin material such as polypropylene.

A plurality of case-side connection portions 20 are provided spaced apart from each other on the outer circumferential surface 16 of the blower case 10. The case-side connection portions 20 extend in the Z direction and outward from the outer circumferential surface 16 of the blower case 10. The case-side connection portions 20 are formed at the same time of molding of the blower case 10. The shape of the case-side connection portions 20 will be described in detail later.

A wire harness holder 18 and a wire harness outlet 19 are provided on the side surface 15 of the blower case 10. A wire harness 72 connected to the motor 70 is drawn out to the outside of the blower case 10 from the wire harness outlet 19 and held on the wire harness holder 18 and a connector installation portion 31*c* of the fixing member 31 (see FIG. 5). The wire harness holder 18 and the wire harness outlet 19 are integrally molded at the same time of molding of the blower case 10.

The wire harness outlet 19 may have a structure of a power supply connector using a male terminal and a female terminal such that the wire harness 72 may be removed from the motor 70.

Figure 5:
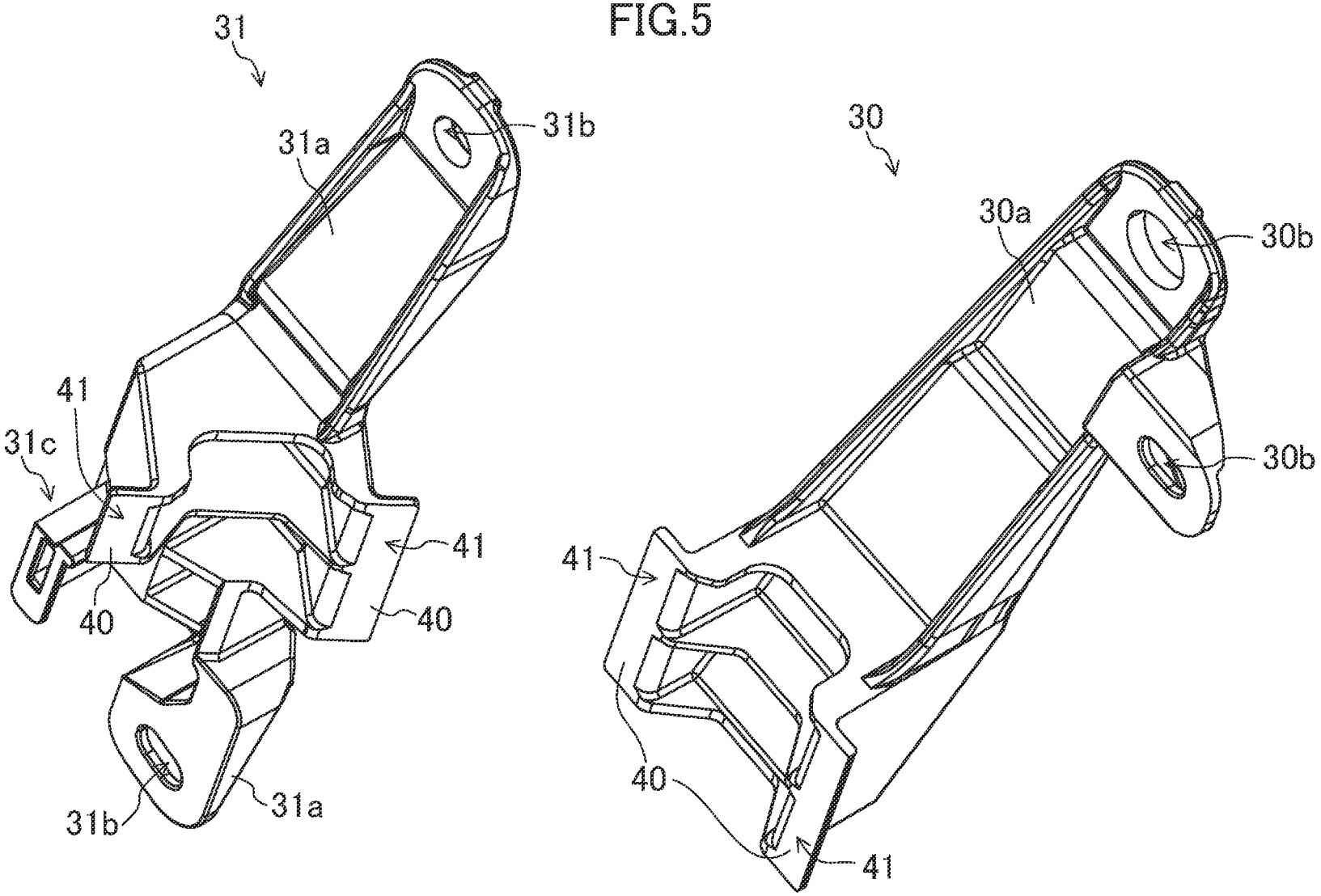
FIG. 5 is a perspective view illustrating fixing members.

The fixing member 30 is a member made of resin and includes a leg 30*a* and a fixing member-side connection portion 40 (see FIG. 5). The leg 30*a* and the fixing member-side connection portion 40 are usually made of resin and are formed integrally. Similarly, the fixing member 31 is a member made of resin and includes a leg 31*a*, a fixing member-side connection portion 40, and the connector installation portion 31*c* (see FIG. 5), The leg 31*a*, the fixing member-side connection portion 40, and the connector installation portion 31*c* are made of resin and formed integrally. The fixing members 30 and 31 are made of the same resin as that of the blower case 10, for example, polypropylene. However, the fixing members 30 and 31 do not contain a component absorbing the above mentioned laser beam of the predetermined wavelength, transmitting the laser beam.

The fixing members 30 and 31 may be made of a material different from that of the blower case 10.

The motor 70 is connected to a connector 73 via the wire harness 72 drawn out from the wire harness outlet 19 provided in the blower case 10. The connector 73 is connected to an external power supply (not shown). As predetermined electric power is supplied to the motor 70 via the wire harness 72, the motor 70 is rotationally driven in a predetermined direction at a predetermined speed. Although not shown, the blower case 10 also houses therein a control substrate on which an electronic component for controlling the rotation of the motor 70 is mounted is housed.

The centrifugal fan 80 is a member obtained by connecting a plurality of metal blade members at predetermined intervals from each other between annular metal members facing each other. The centrifugal fan 80 is coupled to the rotational shaft 71 of the motor 70 in an integrally rotatable manner. The centrifugal fan 80 functions to suck the outside air from the suction port 13, generate an airflow, and discharge the airflow from the exhaust port 14, by rotating in a predetermined direction at a predetermined speed in accordance with the rotation of the motor 70.

The fixing member 30 includes two fixing member-side connection portions 40 (see FIG. 5). The fixing member-side connection portions 40 of the fixing member 30 are connected to the respective two adjacent case-side connection portions 20 provided on the outer circumferential surface 16 of the blower case 10. Similarly, the other fixing member 31 includes two fixing member-side connection portions 40 that are connected to the respective two adjacent case-side connection portions 20. In this way, the fixing members 30 and 31 are attached and fixed to the blower case 10 by connecting the fixing member-side connection portions 40 to the case-side connection portions 20 at four locations in total. The fixing member-side connection portion 40 and the case-side connection portion 20 are welded and connected to each other by laser welding using a laser beam having a predetermined wavelength. This connection method will be described in detail later. The fixing members 30 and 31 have a strength that is sufficient to support the load of the blower case 10 and the like in a case in which the blower case 10 housing the motor 70, the centrifugal fan 80, and the like is disposed on the upper side viewed in the Y direction, and the fixing members 30 and 31 are disposed in the vehicle 200 on the lower side viewed in the Y direction.

The fixing members 30 and 31 attached to the blower case 10 housing the motor 70, the centrifugal fan 80, and the like is further attached and fixed to a frame 210 of the vehicle 200. Mounting holes 30*b* and 31*b* are formed in the legs 30*a* and 31*a* of the fixing members 30 and 31, respectively. Projections (not shown) provided on the frame 210 are fitted into the mounting holes 30*b* and 31*b*, thereby attaching the blower unit 100 to the frame 210. The bottom surfaces of the legs 30*a* and 31*a* are attached to a surface, of the frame 210, that corresponds to an attachment reference surface in the vehicle 200. In this manner, the blower unit 100 is positioned in the vehicle 200, Note that the attachment method of the fixing members 30 and 31 is not limited to the one described above. The two fixing members 30 and 31 and the blower case 10 attached thereto may be attached and fixed to the frame 210 by placing holes (not shown) formed in the frame 210 and the mounting holes 30*b* and 31*b* formed in the legs 30*a* and 31*a* to cover each other so that bolts (not shown) or the like pass therethrough, thereby fastening the fixing members 30 and 31 and the blower case 10 together.

[Structure of Blower Case and Fixing Member]

Figure 3:
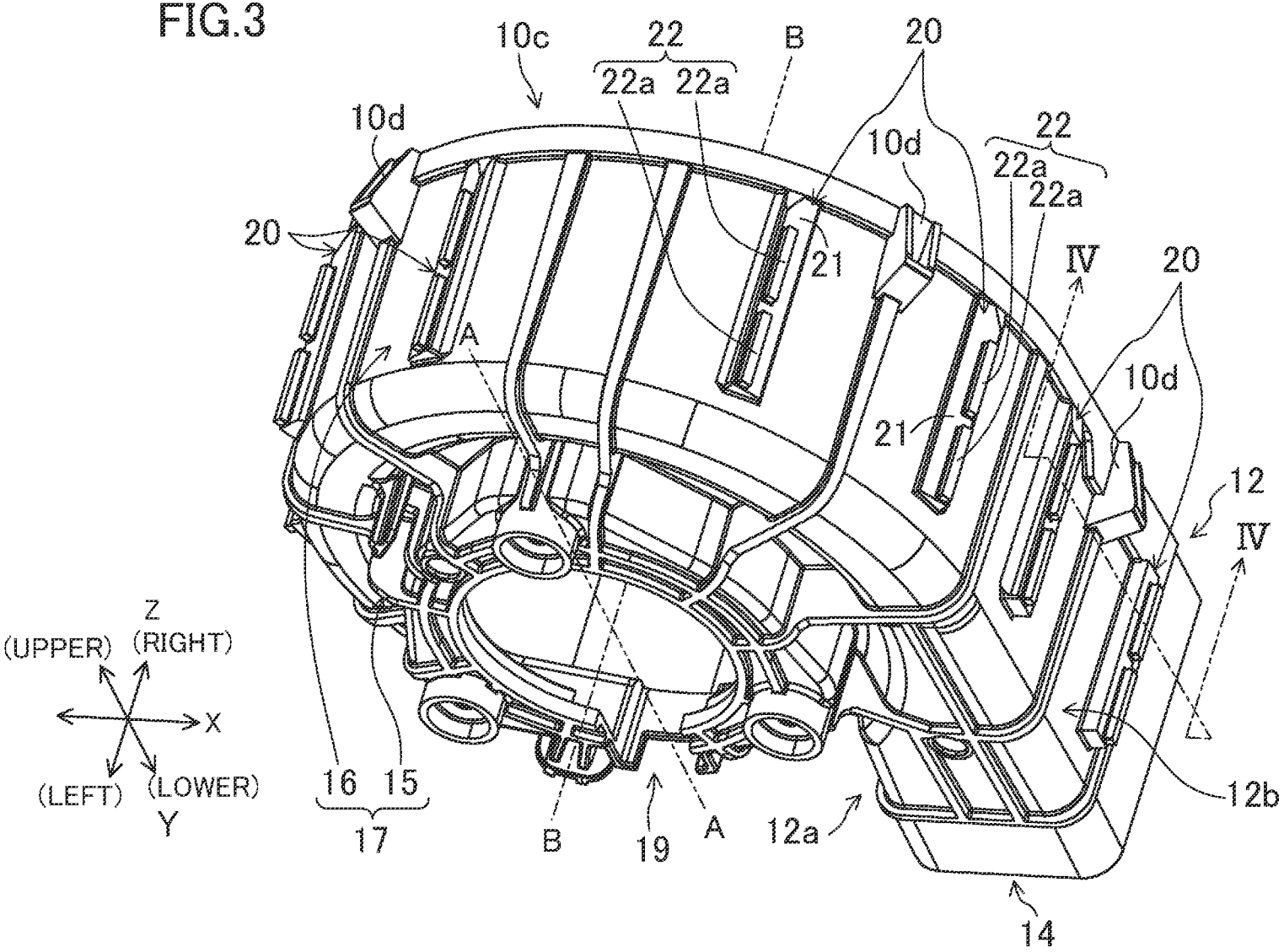
FIG. 3 is a perspective view illustrating a left-side case.
Figure 4:
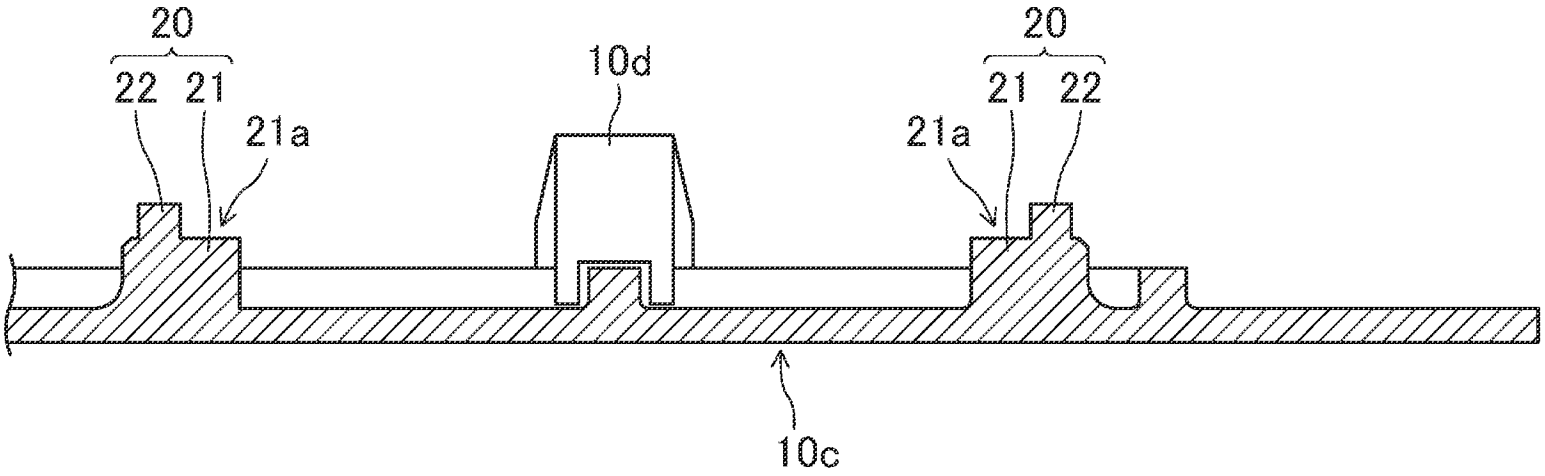
FIG. 4 is a cross-sectional view illustrating a case-side connection portion.

FIG. 3 is a perspective view illustrating a left-side case of the present embodiment. FIG. 4 is a cross-sectional view illustrating a case-side connection portion. FIG. 5 is a perspective view illustrating fixing members. FIG. 4 corresponds to a cross-sectional view taken along line IV-IV of FIG. 3.

As shown in FIGS. 2 and 3, the blower case 10 has a right-side case 10*a* and a left-side case 10*c*. A plurality of locking hooks 10*b* are provided at predetermined intervals from each other on the outer circumferential edge of the right-side case 10*a*. A plurality of locking claws 10*d* are provided at predetermined intervals from each other on the outer circumferential edge of the left-side case 10*c*. The right-side case 10*a* and the left-side case 10*c* are coupled to each other by locking the locking hooks 10*b* with the locking claws 10*d*. For example, after arranging the motor 70 and the centrifugal fan 80 at predetermined positions in the left-side case 10*c*, the left-side case 10*c* is covered with the right-side case 10*a* to couple the left-side case 10*c* and the right-side case 10*a* to each other. Thus, the motor 70 and the centrifugal fan 80 are housed inside the blower case 10. The wire harness holder 18 and the wire harness outlet 19 are provided on the side surface 15 of the left-side case 10*c* (see FIG. 1).

As shown in FIGS. 3 and 4, each case-side connection portion 20 extends, from the outer circumferential surface 16 of the left-side case 10*c*, outward with respect to the blower case 10, and includes a base portion 21 having a case-side planar portion 21*a* and a case-side projection 22 protruding from the case-side planar portion 21*a*. Further, as shown in FIG. 4, for one set of the case-side connection portions 20 that are adjacent to each other, the case-side planar portions 21*a* are provided to the respective case-side connection portions 20 such that the faces of the case-side planar portions 21*a* are parallel to each other. Similarly, for another set of the case-side connection portions 20 that is adjacent to the one set of the case-side connection portions 20, the case-side planar portions 21*a* are provided to the respective case-side connection portions 20 such that the faces of the case-side planar portions 21*a* are parallel to each other. Each case-side projection 22 is divided into two portions with respect to the Z direction that extends in the longitudinal direction of the case-side projection 22, and protrudes from the corresponding one of the case-side planar portions 21*a*. In the following description, each of the divided portions of the case-side projection may also be referred to as a divided projection 22*a*. The expression "parallel to each other" used in the present specification is presumed that there are the manufacturing tolerance of the members and the assembly tolerance of the components. For example, the expression does not mean that the planes to be compared with each other are parallel to each other in a strict sense. Further, the configuration in which two case-side planar portions 21*a* are formed such that the faces thereof are parallel to each other may also include a configuration in which the two case-side planar portions 21*a* are formed on two planes parallel to each other; The two case-side planar portions 21*a* are not necessarily configured to be coplanar.

As shown in FIGS. 1 and 3, the wire harness outlet 19 faces in the same direction as the exhaust port 14, as viewed from the side surface 15 of the left-side case 10*c*. Specifically, as shown in FIG. 3, the wire harness outlet 19 and the air discharge portion 12 are provided as follows: An imaginary plane A and an imaginary plane C (see FIGS. 7 and 8) are parallel to each other, as viewed in the Z direction. The imaginary plane A passes through an imaginary axial line B and the wire harness outlet 19. The imaginary central plane C (see, FIGS. 7 and 8) is positioned between a side surface (hereinafter, referred to as a "first side surface 12*a*") that is one of the side surfaces of the air discharge portion 12 and closer to the imaginary axial line B, and the other side surface (hereinafter, referred to as a "second side surface 12*b*") that is the other of the side surfaces of the air discharge portion 12 and farther from the imaginary axial line B at equal distance from both side surfaces 12*a* and 12*b*. The imaginary axial line B corresponds to the axial line of the rotational shaft 71 in a case in which the motor 70 is housed in the blower case 10.

As shown in FIG. 5, each of the two fixing member-side connection portions 40 provided in the fixing member 30 has a corresponding one of fixing member-side planar portions 41. The two fixing member-side planar portions 41 are provided in the corresponding one of the fixing member-side connection portions 40 to be parallel to each other. Similarly, the fixing member-side planar portions 41 each provided in the two fixing member-side connection portions 40 formed in the fixing member 31 are configured to be parallel to each other.

Note that the configuration in which the two fixing member-side planar portions 41 are parallel to each other may also include a configuration in which the two fixing member-side planar portions 41 are formed on two planes parallel to each other; The two fixing member-side planar portions 41 are not necessarily configured to be coplanar.

As will be described in detail later, the two the fixing member-side connection portions 40 formed in the fixing member 30 are welded to the case-side connection portions 20 in a state in which the two fixing member-side connection portions 40 abut on the respective two case-side projections 22 whose distal end surfaces are parallel to each other. The same applies to the two fixing member-side connection portions 40 formed in the fixing member 31.

[Attachment Method]

Figure 6:
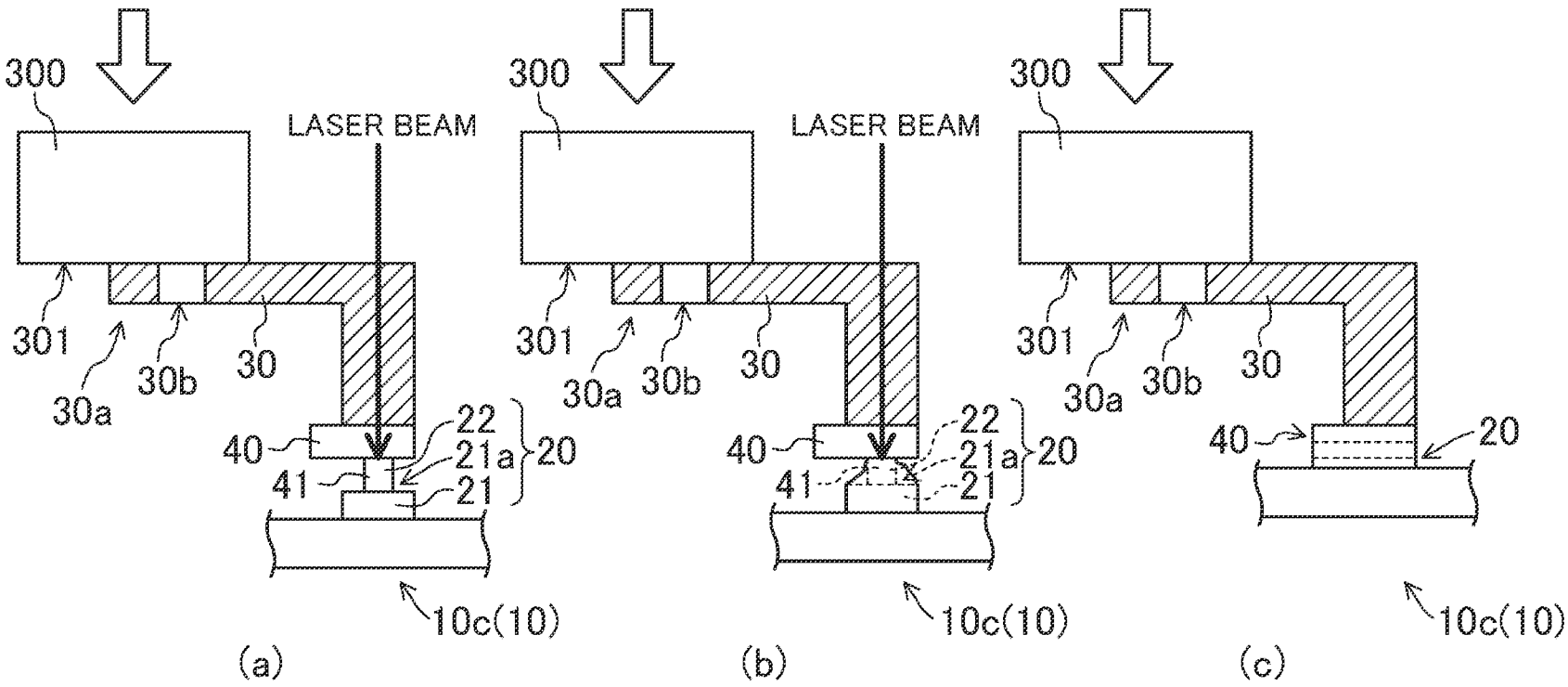
FIG. 6 is a view illustrating attachment steps for attaching the fixing member to a blower case.

FIG. 6 illustrates attachment steps for attaching the fixing member to a blower case. For convenience of description, the shapes of an attachment jig 300 and the fixing member 30, and the shapes of the blower case 10 and the case-side connection portions 20 are simplified in the drawings.

First, as shown in an illustration (a) in FIG. 6, the fixing member 30 is attached to the attachment jig 300 such that the bottom surface of the leg 30*a* comes into contact with a reference surface 301 of the attachment jig 300. The reference surface 301 serves as a reference surface for determining the positional relationship between the fixing member 30 and the blower case 10 in the blower unit 100.

Next, the blower case 10 is set at a predetermined position in accordance with the position of the attachment jig 300. At this time, the blower case 10 is set such that predetermined two of the case-side connection portions 20 are positioned to face the respective two fixing member-side connection portions 40. Further, a set of the case-side connection portions 20 whose respective case-side planar portions 21*a* have faces that are parallel to each other is selected.

The attachment jig 300 is moved toward the blower case 10. The fixing member-side connection portions 40 and the respective case-side connection portions 20 facing the corresponding fixing member-side connection portions 40 are brought into contact with each other. The area of the distal end surface of the case-side projection 22 is smaller than the area of the fixing member-side planar portion 41. The attachment jig 300 moves with respect to the blower case 10 such that the case-side projection 22 abuts on the fixing member-side planar portion 41. At this time, the attachment jig 300 and the fixing member 30 held thereby are pressed against the blower case 10 with a predetermined pressure. In a state in which the fixing member-side connection portion 40 and the case-side connection portion 20 abut on each other, a laser beam having a predetermined wavelength of, for example, 1054 μm is emitted from the side closer to the fixing member 30 toward the portion where the fixing member-side connection portion 40 and the case-side connection portion 20 are in contact with each other. The wavelength of the laser beam is set such that the laser beam is absorbed by the blower case 10 containing a component absorbing the laser beam, while being transmitted through the fixing member 30.

Note that by using an optical component (not shown), the laser beam is applied at once to the entirety of the fixing member-side connection portion 40 and the case-side connection portion 20 which abut on each other. The laser beam may be divided and applied at once to the two sets of the fixing member-side connection portion 40 and the case-side connection portion 20 which abut on each other. The wavelength of the laser beam is not particularly limited to the above value, and may be any wavelength that is absorbed with a predetermined efficiency by the component contained in the blower case 10.

The laser beam is transmitted through the fixing member-side connection portion 40 and is absorbed by the case-side connection portion 20. The case-side projection 22 thus has directly absorbed the laser beam heats up and starts to melt. The fixing member-side connection portion 40 that abuts on the case-side connection portion 20 heats up due to heat conduction. Thus, the fixing member-side connection portion 40 is partially softened or melted. The case-side projection 22 thus softened and melted is deformed so as to expand between the case-side planar portion 21*a* and the fixing member-side planar portion 41 in accordance with the pressure with which the fixing member 30 attached to the attachment jig 300 presses the blower case 10 (illustration (b) of FIG. 6). By pressing the fixing member 30 against the blower case 10 in this state, the melted part of the case-side connection portion 20 including the case-side projection 22, and a part of the fixing member-side connection portion 40 that has heated up to be softened and melted are mixed.

After completion of emission of the laser beam, the fixing member 30 is kept pressed against the blower case 10 for a predetermined time, During this time, the case-side connection portion 20 and the fixing member-side connection portion 40 are naturally cooled. Then, the softened and melted parts of the case-side connection portion 20 and the fixing member-side connection portion 40 solidify. After a lapse of a predetermined time, the case-side connection portion 20 and the fixing member-side connection portion 40 are connected to each other by welding (illustration (c) in FIG. 6).

Although not shown, the fixing member-side connection portion 40 formed in the fixing member 31 is also connected to the corresponding case-side connection portion 20 by welding, thereby completing the attachment of the fixing members 30 and 31 to the blower case 10.

According to the above-described attachment method, the fixing members 30 and 31 are attached such that the bottom surfaces of the legs 30*a* and 31*a* are in contact with the reference surface 301 of the attachment jig 300. Hence, the fixing members 30 and 31 are attached to the blower case 10 after being positioned with respect to the bottom surfaces of the legs 30*a* and 31*a* that are reference surfaces for attaching the blower unit 100 to the vehicle 200. Thus, the blower unit 100 can be attached at a predetermined position in the vehicle 200 such that the exhaust port 14 faces a desired position and forms a desired angle, and that a device to be cooled such as a storage battery can be reliably cooled.

[Advantages]

As described above, the blower unit 100 of the present embodiment includes at least the blower case 10 that is hollow, the motor 70 that is housed in the blower case 10 and has the rotational shaft 71 extending in a predetermined direction, the centrifugal fan 80 housed in the blower case 10 and coupled to the rotation shaft 71 of the motor 70 in an integrally rotatable manner, and the wire harness outlet 19. The wire harness outlet 19 is provided in either the motor 70 and or blower case 10, From the wire harness outlet 19, a wire harness 72 supplying electric power to the motor 70 is drawn out to the outside of the motor 70 or the blower case 10.

The blower case 10 includes the outer surface 17 including the two side surfaces 15 facing each other at a predetermined interval, and the outer circumferential surface 16 that extends from the outer circumferential edge of one side surface 15 to the outer circumferential edge of the other side surface 15 and is continuous with the two side surfaces 15. The blower case 10 includes the suction port 13 provided in either one of the two side surfaces 15, and the air discharge portion 12 that extends from the outer circumferential surface 16 and includes, at its distal end, an exhaust port 14 discharging an airflow.

The exhaust port 14 and the wire harness outlet 19 face in the same direction as viewed from the side surface 15 of the blower case 10. Further, the wire harness outlet 19 and the air discharge portion 12 are provided such that the imaginary plane A and the imaginary central plane C are parallel to each other as viewed from the side surface 15 of the blower case 10. The imaginary plane A passes through the rotational shaft 71 and the wire harness outlet 19. The imaginary central plane C is positioned between the first side surface 12*a* being positioned on a side closer to the rotational shaft 71 and the second side surface 12*b* being position on a side farther from the rotational shaft 71, of the four side surfaces of the air discharge portion 12 at equal distance from both side surfaces 12*a* and 12*b*.

Such the configuration of the blower unit 100 makes it possible to reduce the risk that moisture enters the inside of the motor 70 through the wire harness 72, This point will be further described with reference to the drawings.

Figure 7:
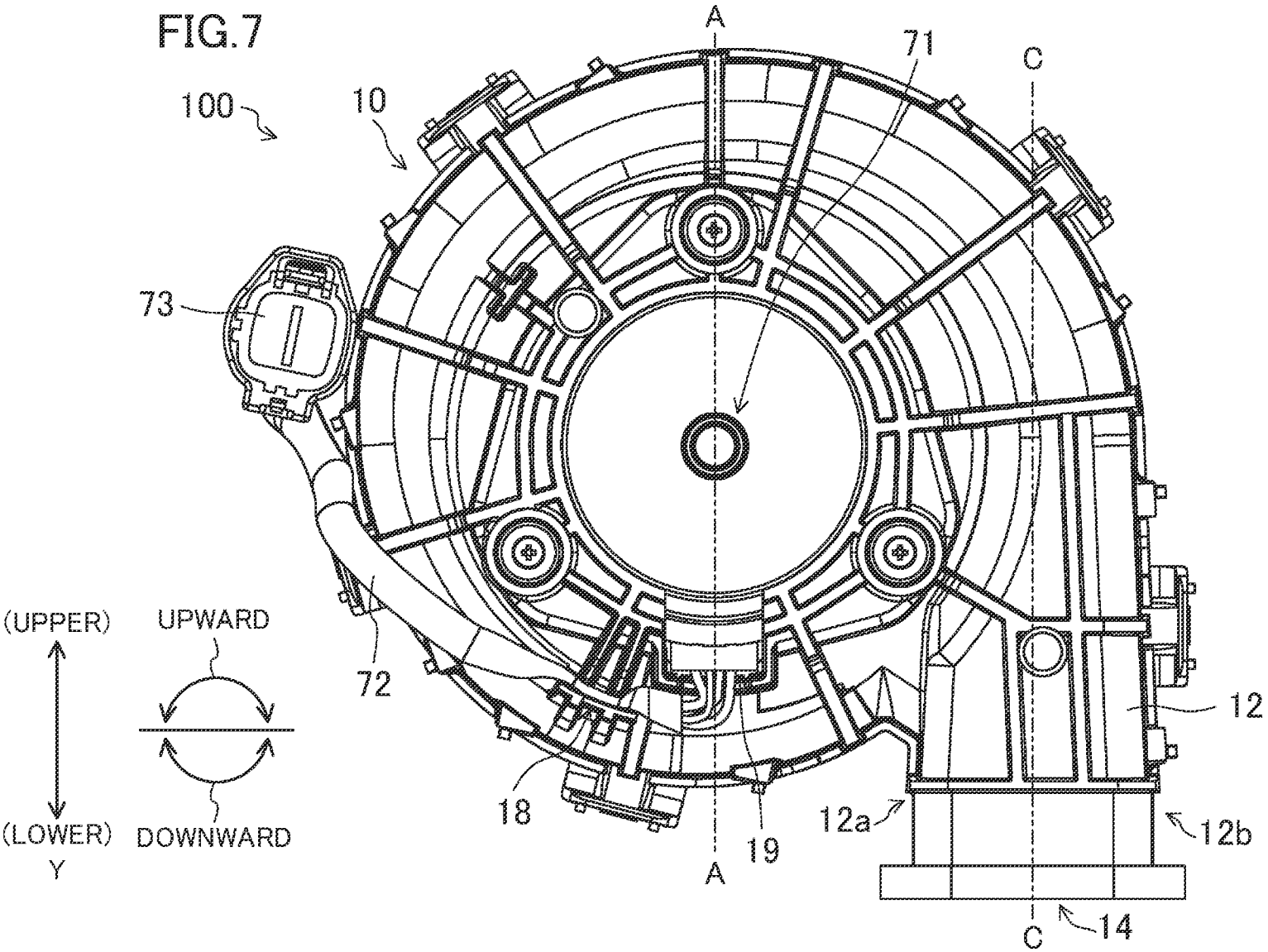
FIG. 7 is a side view illustrating the blower unit.
Figure 8:
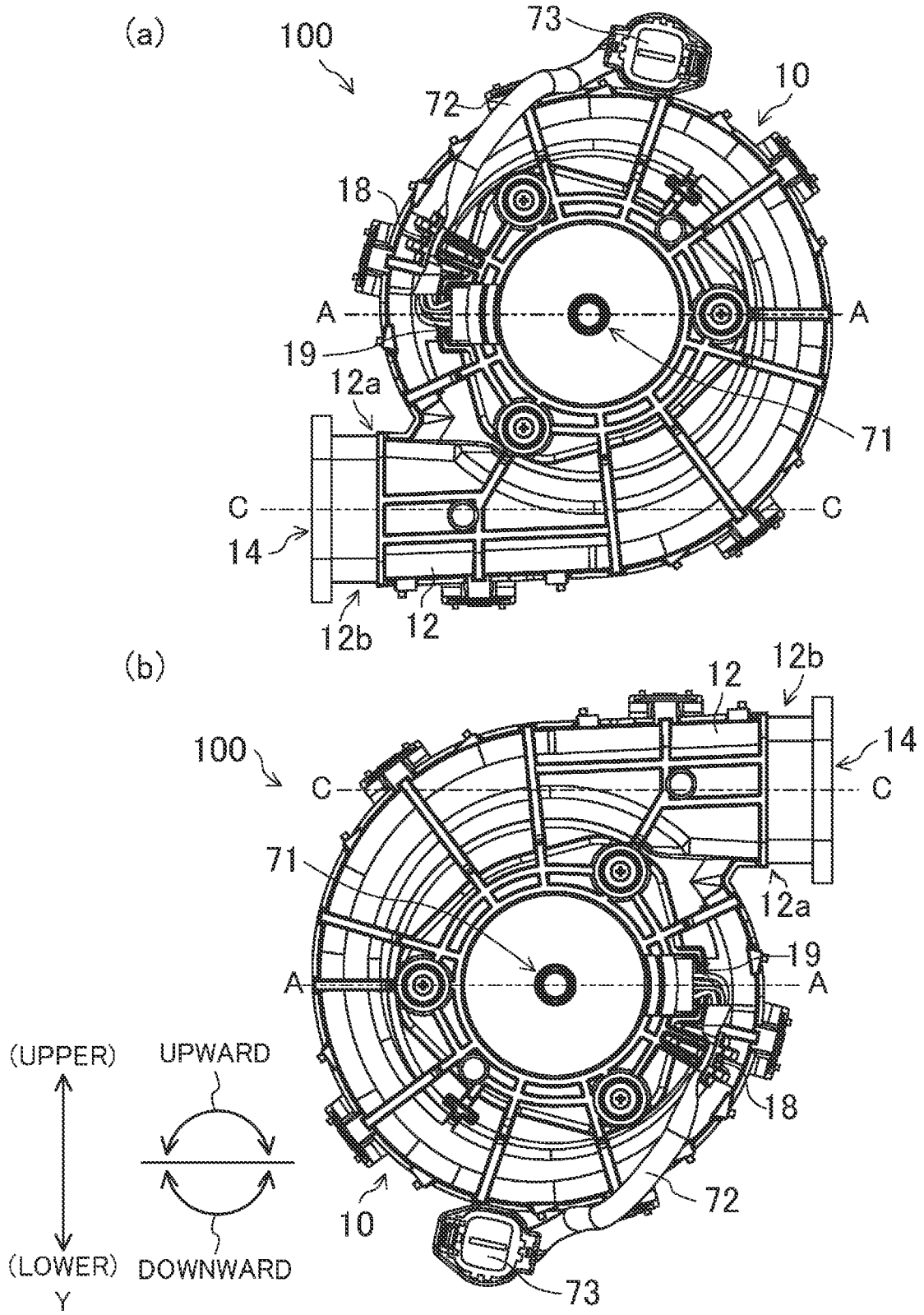
FIG. 8 is a side view illustrating another blower unit.

FIGS. 7 and 8 are side views illustrating each side of the blower unit 100. Specifically, FIG. 7 is a side view illustrating a case in which the wire harness outlet 19 and the exhaust port 14 face the lower side in the V direction, that is, the lower side in the vertical direction. FIG. 8 is a side view illustrating a case in which the wire harness outlet 19 and the exhaust port 14 face in a direction that forms a 90° angle with the vertical direction. For convenience of explanation, the fixing members 30 and 31 are omitted in FIGS. 7 and 8.

The moisture adhered to the wire harness 72 flows downward along the wire harness 72 under the influence of gravity. On the other hand, as described above, the blower unit 100 is attached in the vehicle 200 such that the exhaust port 14 always faces downward.

Therefore, the blower case 10 is designed such that the exhaust port 14 and the wire harness outlet 19 face in the same direction beforehand, thereby making the wire harness outlet 19 always facing downward, as well. Thus, even if moisture adheres to the wire harness 72, the moisture is kept from entering the inside of the motor 70 through the wire harness outlet 19. Likewise, in the cases shown in illustrations (a) and (b) of FIG. 8, it is possible to reduce the risk that moisture enters the inside of the motor 70 through the wire harness 72.

As thus described above, it is possible to reduce the risk that moisture enters the inside of the motor 70. Hence, it is possible to reduce the risk of malfunction of the blower unit 100 caused by an electric failure of an electronic component (not shown), such as a short circuit, mounted on the control substrate (not shown) of the motor 70 housed inside the blower case 10.

The blower unit 100 includes at least a fixing member 30 that is provided separately from the blower case 10 and has a fixing member-side connection portion 40. The blower case 10 includes a plurality of case-side connection portions 20, provided on the outer surface 17, for attaching and fixing the fixing member 30 to the blower case 10 by being connected to the fixing member-side connection portions 40.

Such the configuration of the blower unit 100 eliminates the need to change the design of the shape of the blower case 10, even in a case in which the attachment position and the attachment angle of the fixing member 30 inside the vehicle 200 are changed. This allows for standardization of the design specification. Accordingly, it is possible to reduce an increase in the design man-hours and the manufacturing costs of the blower unit 100.

In the blower unit 100 of the present embodiment, a plurality of case-side connection portions 20 are provided spaced apart from each other on the outer circumferential surface 16 of the blower case 10. Two of the case-side connection portions 20 selected from the plurality of case-side connection portions 20, specifically, the two of the case-side connection portions 20, which are adjacent to each other and include surfaces of the respective case-side planar portions 21*a* parallel to each other, are provided in the fixing member 30 and connected to the two of the fixing member-side connection portions 40 each having the fixing member-side planar portions 41. The fixing member-side planar portions 41 provided respectively to the two of the fixing member-side connection portions 40 are parallel to each other. Further, the fixing member-side planar portion 41 and the surface of the case-side planar portion 21*a* facing the fixing member-side planar portion 41 are provided to be parallel to each other before attaching the fixing member 30 to the blower case 10.

Such the configuration makes it possible to attach the fixing member 30 to the blower case 10 while keeping the position and parallelism of the blower case 10 with respect to the reference surface of the fixing member 30, specifically, the bottom surface of the leg 30*a* predetermined. In addition, the blower case 10 is connected to one fixing member 30 at two positions. Thus, the blower unit 100 with excellent quality in connection strength can be achieved. Further, arranging the plurality of case-side connection portions 20 on the outer circumferential surface 16 of the blower case 10 makes it possible to downsize the case-side connection portions 20 and the fixing member-side connection portions 40, and improve the degree of freedom of the attachment position of the fixing member 30 to the blower case 10. In addition, the load of a heavy object such as the motor 70 housed in the blower case 10 can be easily supported on the fixing member 30.

The blower unit 100 further includes the fixing member 31. The two fixing member-side connection portions 40 provided in the fixing member 31 and the two case-side connection portions 20 provided at predetermined positions on the blower case 10 are connected to each other in the same manner as described above.

In this way, the two fixing members 30 and 31 are attached to the blower case 10. Thus, the blower unit 100 can be more stably attached in the vehicle 200. Further, the total strength of connection between the blower case 10 and the fixing members 30 and 31 can be improved.

The blower case 10 and the fixing members 30 and 31 are made of resin. The case-side connection portions 20 and the fixing member-side connection portions 40 are connected to each other by laser welding.

Welding the case-side connection portions 20 and the fixing member-side connection portions 40 to each other allows for improvement of the adhesion between the connecting portions and increase of the strength quality. According to the laser welding method, no vibration is applied to the blower unit 100 in contrast to the ultrasonic welding method described later. Thus, there is no fear that mechanical damage is applied to the electronic component (not shown) mounted on the control substrate (not shown) inside the motor 70 and to a bearing (not shown) of the motor 70. The fixing members 30 and 31 are attached to the blower case 10 using the attachment jig 300. Hence, the positioning accuracy of the blower case 10 with respect to the fixing members 30 and 31 can be improved. Accordingly, for example, when the blower unit 100 is attached to the frame 210 of the vehicle 200, the exhaust port 14 can be directed toward a desired position and at a desired angle, and a device to be cooled can be reliably cooled. The blower case 10 and the fixing members 30 and 31 are made of resin. Hence, the weight of the blower unit 100 can be reduced.

In addition, for the laser welding using a laser beam having a predetermined wavelength, the fixing members 30 and 31 are made of resin that transmits the laser light and the blower case 10 is made of resin that absorbs the laser light. Accordingly, the laser welding may be performed by making the laser beam incident from the side closer to the fixing member 30 or 31. In this way, the bottom surfaces of the legs 30*a* and 31, which serve as reference surfaces for mounting the blower unit 100 in the vehicle 200, may be mounted directly on the reference surface 301 of the attachment jig 300, thereby improving the positioning accuracy of the blower case 10 with respect to the fixing members 30 and 31.

The case-side connection portion 20 includes the base portion 21 having case-side planar portion 21*a*, and the case-side projection 22 formed to extend from the case-side planar portion 21*a*. The fixing member-side connection portion 40 includes the fixing member-side planar portion 41. The case-side connection portion 20 and the fixing member-side connection portion 40 are welded to each other in a state in which the case-side projection 22 and the fixing member-side planar portion 41 are in contact with each other.

As the case-side connection portion 20 and the fixing member-side connection portion 40 are thus formed into the above-mentioned shapes, it is possible to improve the quality of the strength of connection between the blower case 10 and the fixing members 30 and 31, and improve the positioning accuracy and parallelism of the blower case 10 with respect to the fixing members 30 and 31. This point will be further described with reference to the drawings.

Figure 9:
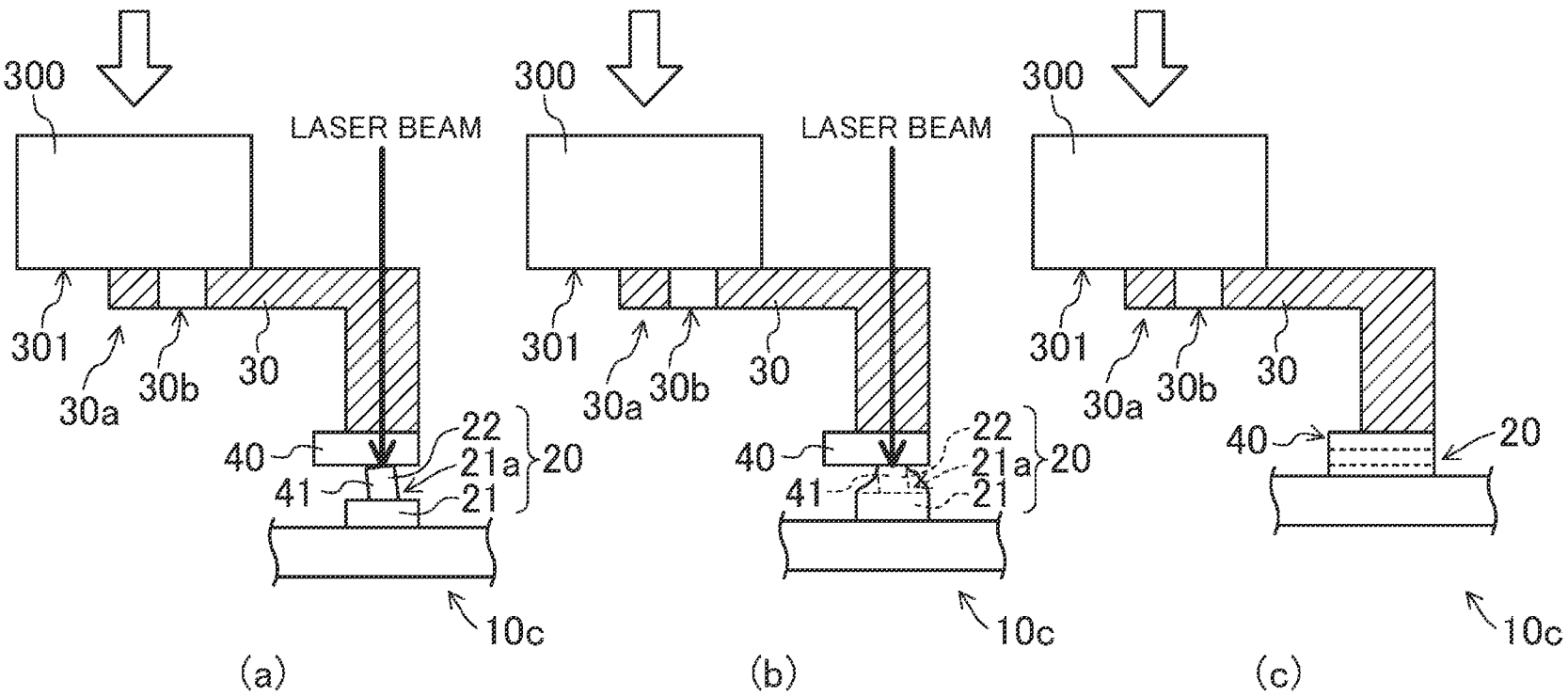
FIG. 9 is a view illustrating attachment steps in a case a shape error is found in the blower case.

FIG. 9 illustrates attachment steps in a case a shape error is found in at least one of the blower case or the fixing member. Specifically, FIG. 9 illustrates a case in which a shape error is found in the case-side projection 22. Note that the illustrations (a) to (c) in FIG. 9 correspond to the illustrations (a) to (c) in FIG. 6, respectively.

In the example shown in FIG. 9, the case-side projection 22 is provided to be inclined as compared to the normal position shown in FIG. 6. Accordingly, the distal end surface of the case-side projection 22 is inclined as compared to the predetermined position to abut on the fixing member-side planar portion 41.

In this state, when the laser beam is emitted from the side closer to the fixing member 30, the case-side projection 22 is melted and deformed as described above. On the other hand, even in the case of shape error found in the case-side connection portion 20, the case-side projection 22 expands between the case-side planar portion 21*a* and the fixing member-side planar portion 41 and is deformed to fill the space therebetween, making it possible to absorb the error. Similarly, even in the case of shape error found in the fixing member-side connection portion 40, the case-side projection 22 is deformed to fill the space between the case-side planar portion 21*a* and the fixing member-side planar portion 41, making it possible to absorb the error. Further, a part of the base portion 21 and a part of the fixing member-side connection portion 40 are softened and melted, which increases the degree of absorption of the shape error. Finally, in a state in which the melted part of the case-side connection portion 20 including the case-side projection 22 is heated and softened, the position adjustment done by the reference surface 301 of the attachment jig 300 is performed, making adjustment in absorption of the shape error. In this way, according to the present embodiment, the final attachment position and the like may be almost the same as a case in which no shape error is found. In this manner, it is possible to reduce a decrease in the positioning accuracy and parallelism of the blower case 10 with respect to the fixing members 30 and 31 due to the shape error of the blower case 10 and the fixing members 30 and 31.

Further, in the blower unit 100 of the present embodiment, the area of the distal end of the case-side projection 22 is smaller than the area of the fixing member-side planar portion 41.

Such the configuration of the case-side projection 22 and the fixing member-side planar portion 41 reduces the risk that the case-side projection 22 extends beyond the fixing member-side planar portion 41 to the outside when the case-side projection 22 is melted. This makes it possible to reduce the error in attachment between the fixing members 30 and 31 and the blower case 10.

In addition, providing the case-side projection 22 such that it protrudes from the case-side planar portion 21*a* allows the case-side projection 22 melted by the incident laser beam to deform to fill the space between the case-side planar portion 21*a* and the fixing member-side planar portion 41. In this manner, the melted case-side projection 22 adheres also to the case-side planar portion 21*a* whose area is larger than that of the distal end of the case-side projection 22. Hence, the case-side planar portion 21*a* and the fixing member-side planar portion 41 are substantially welded. This increases the connection area between the fixing member-side connection portion 40 and the case-side connection portion 20, thereby increasing the strength of connection between the blower case 10 and the fixing members 30 and 31.

The case-side projection 22 includes the divided projection 22*a* divided into two in the Z direction in which the case-side projection 22 extends. In particular, the case-side projection 22 of the present embodiment includes the divided projection 22*a* that is divided into two in the Z direction in which the case-side projection 22 extends and extends between the two side surfaces 15, The two divided projections 22*a* divided in the Z direction are provided on the case-side planar portion 21*a* at a predetermined interval from each other in the Z direction.

This configuration of the case-side projection 22 allows the blower case 10 and the fixing member 30 or 31 to be reliably connected to each other, even if some of the fixing member-side connection portions 40 are shorter than others.

For example, as shown in FIG. 5, the fixing member 31 includes a connector installation portion 31*c*. Of the two fixing member-side connection portions 40 provided to the fixing member 31, the fixing member-side connection portion 40 on the side closer to the connector installation portion 31*c* is shorter than the other one so as not to cover the connector installation portion 31*c*. In such a case, if one of the case-side projections 22 is a projection extending in the Z direction, a failure may occur during the welding the fixing member-side connection portion 40 and the case-side connection portion 20. This point will be further described with reference to the drawings.

Figure 10:
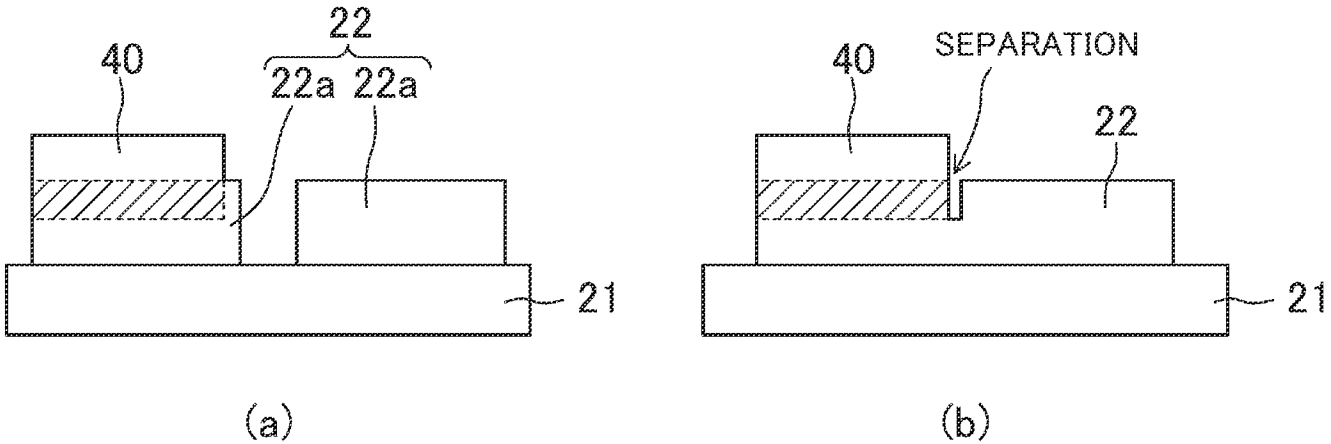
FIG. 10 is a schematic cross-sectional view illustrating a state of connection between the case-side connection portion and a fixing member-side connection portion.

FIG. 10 is a schematic cross-sectional view illustrating a state of connection between the case-side connection portion and the fixing member-side connection portion. The illustration (a) shows a state in which the case-side projection is divided into two in the Z direction, that is, the state of the present embodiment. The illustration (b) shows a state in which an undivided case-side projection extends in the Z direction.

As shown in the illustration (b) of FIG. 10, in a case in which the length of the fixing member-side connection portion 40 is shorter than the length of the case-side projection 22 in the 7 direction, not only the case-side projection 22 and the fixing member-side planar portion 41 are welded to each other, but also the case-side projection 22 and the side surface of the fixing member-side connection portion 40 are welded.

However, the laser beam may not be sufficiently emitted on the side surface of the case-side projection 22. In such a case, the joint strength at the corresponding portion may decrease, making the fixing member 31 separated from the blower case 10. In such a state, the strength of connection between the blower case 10 and the fixing member 31 is not maintained, and there has been a fear in that the blower case 10 may get detached from the fixing member 31 due to vibration in the vehicle 200, for example.

On the other hand, according to the present embodiment, as shown in the illustration (a) of FIG. 10, the case-side projection 22 includes the two divided projections 22*a* provided at a predetermined interval from each other. Therefore, the risk of the case-side projection 22 being insufficiently welded to the side surface of the fixing member-side connection portion 40 is reduced, and the strength of connection between the case-side connection portions 20 and the fixing member-side connection portion 40 may be adequately ensured. Thus, the blower case 10 and the fixing member 31 may be reliably connected to each other. In addition, the case-side projection 22 has a shape that makes it possible to adapt to a difference in length of the fixing member-side connection portion 40, in particular, a difference in length in the Z direction. Therefore, it is possible to improve the degree of freedom in designing the shape of the fixing member 31.

Further, as shower FIG. 5, each of the two fixing member-side connection portions 40 provided in the fixing member 30 protrudes in the direction opposite to the direction in which the fixing member-side connection portions 40 face each other. Furthermore, the surfaces to be connected to the case-side connection portion 20 are parallel to each other. Similarly, each of the two fixing member-side connection portions 40 provided in the fixing member 31 protrudes in the direction opposite to the direction in which the fixing member-side connection portions 40 face each other. Further, the surfaces to be connected to the case-side connection portion 20 are parallel to each other. This configuration is to prevent a laser beam-emitting device (not shown) that is fixed to the attachment jig 300 from coming into contact with the fixing members 30 and 31 when the device emits laser beam toward the case-side projection 22 from a position directly above the fixing member-side connection portion 40.

In the attachment structure for attaching the blower unit 100 inside the vehicle 200 of the present embodiment, the bottom surfaces of the legs 30*a* and 31*a* provided in the fixing members 30 and 31 are installed on the surface of the frame 210 that is the mounting reference surface in the vehicle 200, and the wire harness outlet 19 faces a lower side within a range between −90° and +90° with reference to a lower side in a vertical direction.

In the blower unit 100, the exhaust port 14 and the wire harness outlet 19 face in the same direction. Thus, by providing the wire harness outlet 19 as described above, the exhaust port 14 always faces downward. Hence, a foreign object does not enter the blower unit 100 through the exhaust port 14. Thus, it is possible to reduce the risk of damage on the motor 70 and the centrifugal fan 80. In addition to the effect of reducing the risk of entrance of the moisture, it is possible to improve the operational reliability of the blower unit 100 and to achieve a longer life of the blower unit 100.

Other Embodiments

The shape of the case-side connection portion 20 and the fixing member-side connection portion 40 are not particularly limited to the shape of the first embodiment: Other shapes may be appropriately employed as necessary. For example, the case-side projection 22 may have a tapered shape in which the width decreases toward the distal end. In this case, the cross-sectional shape of the case-side projection 22 may be a triangle, a trapezoid, or a rounded shape having a predetermined radius of curvature at the distal end.

The case-side projection 22 may protrude directly from the outer circumferential surface 16 the blower case 10. Alternatively, the case-side projection 22 may be omitted, the case-side planar portion 21*a* provided on the base portion 21 and the fixing member-side planar portion 41 may face each other, and the case-side connection portion 20 and the fixing member-side connection portion 40 may be welded to each other in a state in which the case-side planar portion 21*a* and the fixing member-side planar portion 41 are in contact with each other. In this case, the shape of the base portion 21 is preferably set such that the case-side planar portion 21*a* provided in each of the two adjacent base portions 21 connected to one fixing member 30 are parallel to each other. Further, the area of the case-side planar portion 21*a* and the area of the fixing member-side planar portion 41 are preferably the same. In this way, the connection area between the case-side connection portion 20 and the fixing member-side connection portion 40 may be increased.

The case-side connection portion 20 and the fixing member-side connection portion 40 may be welded and connected to each other by ultrasonic welding. In this case, a fixing member-side projection (not shown) may be provided on the fixing member-side planar portion 41 instead of the case-side projection 22. The fixing member-side projection may have a tapered to increase stress between the fixing member-side projection and the case-side planar portion 21*a*, facilitating heat generation. In this case, the cross-sectional shape of the fixing member-side projection may be a triangle, a trapezoid, or a rounded shape having a predetermined radius of curvature at the distal end.

In the first embodiment, the blower case 10 and the fixing members 30 and 31 are made of resin; However, the material is not limited to this. For example, the blower case 10 may be made of resin, and the fixing members 30 and 31 may be made of metal material to secure the strength of attachment to the frame 210, supporting the load of the motor 70 and the like. In this case, the case-side connection portion 20 and the fixing member-side connection portion 40 may be connected to each other by ultrasonic welding. Alternatively, the blower case 10 and the fixing members 30 and 31 may be both made of metal material. In this case, the case-side connection portion 20 and the fixing member-side connection portion 40 may be connected to each other by laser welding, ultrasonic welding, or thermal caulking.

Although the case-side connection portion 20 is provided on the outer circumferential surface 16 of the blower case 10, the case-side connection portion 20 may be provided on the side surface 15 of the blower case 10. The case-side connection portion 20 may be provided on both of the side surface 15 and the outer circumferential surface 16 of the blower case 10. In this way, it is possible to improve the degree of freedom of the attachment position and the angle of the fixing members 30 and 31 with respect to the blower case 10, and consequently the flexibility of the attaching position and angle of the blower unit in the vehicle 200.

In the first embodiment, the number of the fixing members 30 and 31 is two; However, the number is not particularly limited thereto, and may be one, three, or more, as far as the connection strength is ensured.

In the first embodiment, the connector 73 is provided at the end portion of the wire harness 72 on the side opposite to the wire harness outlet 19. However, the connector 73 may be fitted into an opening provided in the side surface 15 of the blower case 10. In this case, the connector 73 corresponds to the wire harness outlet 19, and the connector 73 and the exhaust port 14 face in the same direction. Also in this case, as in the case of the first embodiment, it is possible to reduce the risk that moisture enters the inside of the motor 70 through the wire harness 72 connected to the connector 73.

Further, the motor 70 may not be completely housed in the blower case 10, and the motor 70 may project partially to the outside of the blower case 10. In this case, the wire harness outlet 19 may be provided at a part of the motor 70 projecting to the outside of the blower case 10.

That is, the blower unit 100 may include at least the blower case 10 that is hollow, the motor 70 that is partially housed in the blower case 10 and having the rotational shaft 71 extending in the Z direction, the centrifugal fan 80 housed in the blower case 10 and coupled to the rotational shall 71 of the motor 70 in an integrally rotatable manner, and the wire harness outlet 19 provided in either the motor 70 or the blower case 10 so that the wire harness 72 supplying power to the motor 70 is drawn out to the outside of the motor 70 or the blower case 10. Also in this case, the exhaust port 14 and the wire harness outlet 19 face in the same direction, as viewed from the side surface 15 of the blower case 10. Thus, advantages similar to those of the first embodiment are achieved.

INDUSTRIAL APPLICABILITY

The blower unit of the present invention may reduce the risk that moisture enters the blower unit through the wire harness, and is thus particularly useful when mounted in a vehicle.

DESCRIPTION OF REFERENCE CHARACTERS

10 Blower Case (Case)
10*a* Right-side Case
10*b* Locking Hook
10*c* Left-side Case
10*d* Locking Claw
11 Device Housing
12 Air Discharge Portion
12*a* First Side Surface
12*b* Second Side Surface
13 Suction Port
13*a*, 14*a* Sealing Member
14 Exhaust Port
15 Side Surface
16 Outer Circumferential Surface
17 Outer Surface
18 Wire Harness Holder
19 Wire Harness Outlet
20 Case-side Connection Portion
21 Base Portion
21*a* Case-side Planar Portion
22 Case-side Projection
22*a* Divided Projection
30, 31 Fixing Member
30*a*, 31*a* Leg
30*b*, 31*b* Mounting Hole
31*c* Connector Installation Portion
40 Fixing Member-side Connection Portion
41 Fixing Member-side Planar Portion
70 Motor
71 Rotational Shaft
72 Wire Harness
73 Connector
80 Centrifuged Fan
100 Blower Unit
200 Vehicle
210 Frame
300 Attachment Jig
301 Reference Surface of Attachment Jig 300
A Imaginary Plane
B Imaginary Axial Line
C Imaginary Central Plane

The invention claimed is:

1. A blower unit comprising at least:

a hollow blower case;

a motor that is partially housed in the blower case and has a rotational shaft extending in a predetermined direction;

a centrifugal fan housed in the blower case and coupled to the rotational shaft of the motor in an integrally rotatable manner; and a wire harness outlet provided in either one of the motor or the blower case so that a wire harness supplying power to the motor is drawn out to an outside of the motor or the blower case, wherein:

the blower case includes:

an outer surface that includes: two side surfaces facing each other at a predetermined interval; and an outer circumferential surface extending from an outer circumferential edge of one of the two side surfaces to an outer circumferential edge of another one of the two side surfaces, and is continuous with the two side surfaces, a suction port provided in either one of the two side surfaces, and an air discharge portion extending from the outer circumferential surface and including, at a distal end thereof, an exhaust port discharging an airflow;

the exhaust port and the wire harness outlet face in a same direction as viewed from either one of the two side surfaces of the blower case; and the wire harness outlet is provided in either one of the two side surfaces of the blower case.

2. The blower unit of claim 1, wherein the air discharge portion further includes: a first discharge portion side surface that extends away from the rotational shaft, and positioned on a side closer to the rotational shaft; and a second discharge portion side surface positioned on a side farther from the rotational shaft, and an imaginary plane passes through the rotational shaft and the wire harness outlet, an imaginary central plane is positioned between the first discharge portion side surface and the second discharge portion side surface at an equal distance from the first discharge portion side surface and the second discharge portion side surface, and the imaginary plane and the imaginary central plane are parallel to each other as viewed from either one of the two side surfaces.

3. The blower unit of claim 1, further comprising:

a fixing member that is provided separately from the blower case and has a fixing member-side connection portion, wherein the blower case includes a plurality of case-side connection portions that are provided on the outer surface and used for attaching and fixing the fixing member to the blower case by being connected to the fixing member-side connection portion.

4. The blower unit of claim 3, wherein a predetermined case-side connection portion, which is selected from the plurality of case-side connection portions, and the fixing member-side connection portion are connected to each other.

5. The blower unit of claim 4, wherein a second predetermined case-side connection portion, which is selected from the plurality of case-side connection portions, is connected to the fixing member-side connection portion.

6. The blower unit of claim 5, wherein the fixing member-side connection portion comprises a plurality of fixing member-side connection portions which protrude in a direction opposite to a direction in which the plurality of the fixing member-side connection portions face each other, and the plurality of the fixing member-side connection portions are formed such that surfaces to be connected to the plurality of case-side connection portions are parallel to each other.

7. The blower unit of claim 3, wherein the fixing member includes a plurality of fixing members, and each of the plurality of the fixing members is attached and fixed to the blower case by connecting fixing member-side connection portions provided to each of the plurality of the fixing members and at least two of the case-side connection portions selected from the plurality of case-side connection portions to each other.

8. The blower unit of claim 3, wherein the plurality of the case-side connection portions are provided at intervals from each other on the outer circumferential surface.

9. The blower unit of claim 3, wherein the blower case and the fixing member are made of resin.

10. The blower unit of claim 9, wherein the case-side connection portion and the fixing member-side connection portion are connected to each other by welding.

11. A blower unit attachment structure in which the blower unit of claim 3 is attached to a vehicle, wherein a bottom surface of a leg provided in the fixing member is installed on a predetermined reference surface inside the vehicle, and the wire harness outlet faces a lower side within a range between −90° and +90° with reference to a lower side in a vertical direction.

12. A blower unit comprising at least:

a hollow blower case;

a motor that is partially housed in the blower case and has a rotational shaft extending in a predetermined direction;

a centrifugal fan housed in the blower case and coupled to the rotational shaft of the motor in an integrally rotatable manner; and a structure of a power supply connector provided in either one of the motor or the blower case, wherein a wire harness to supply power to the motor is attached to the structure of a power supply connector, and wherein:

the blower case includes:

an outer surface that includes: two side surfaces facing each other at a predetermined interval; and an outer circumferential surface extending from an outer circumferential edge of one of the two side surfaces to an outer circumferential edge of another one of the two side surfaces, and is continuous with the two side surfaces, a suction port provided in either one of the two side surfaces, and an air discharge portion extending from the outer circumferential surface and including, at a distal end thereof, an exhaust port discharging an airflow;

the exhaust port and the structure of a power supply connector face in a same direction as viewed from either one of the two side surfaces of the blower case; and the structure of the power supply connector is provided in either one of the two side surfaces of the blower case.

13. The blower unit of claim 12, wherein the air discharge portion further includes: a first discharge portion side surface that extends away from the rotational shaft, and positioned on a side closer to the rotational shaft; and a second discharge portion side surface positioned on a side farther from the rotational shaft, and an imaginary plane passes through the rotational shaft and the structure of the power supply connector, an imaginary central plane is positioned between the first discharge portion side surface and the second discharge portion side surface at an equal distance from the first discharge portion side surface and the second discharge portion side surface, and the imaginary plane and the imaginary central plane are parallel to each other as viewed from either one of the two side surfaces.

14. The blower unit of claim 12, further comprising:

a fixing member that is provided separately from the blower case and has a fixing member-side connection portion, wherein the blower case includes a plurality of case-side connection portions that are provided on the outer surface and used for attaching and fixing the fixing member to the blower case by being connected to the fixing member-side connection portion.

15. A blower unit attachment structure in which the blower unit of claim 12 is attached to a vehicle, wherein a bottom surface of a leg provided in a fixing member is installed on a predetermined reference surface inside the vehicle, and the structure of the power supply connector faces a lower side within a range between −90° and +90° with reference to a lower side in a vertical direction.

* * * * *